US006792652B2

(12) United States Patent
Ferrario

(10) Patent No.: US 6,792,652 B2
(45) Date of Patent: Sep. 21, 2004

(54) UNFOLDING CLASP FOR BRACELET

(76) Inventor: Luigi Ferrario, Route des Cheintres, 3, Marin-Epagnier (CH), CH-2074

( * ) Notice: Subject to any disclaimer, the term of this patent is extended or adjusted under 35 U.S.C. 154(b) by 0 days.

(21) Appl. No.: 10/374,226

(22) Filed: Feb. 25, 2003

(65) Prior Publication Data

US 2004/0163217 A1 Aug. 26, 2004

(51) Int. Cl.[7] ..... A44C 5/24
(52) U.S. Cl. ..... 24/71 J; 24/265 WS
(58) Field of Search ..... 24/71 R, 71 J, 24/68 J, 69 J, 70 J, 265 WS, 71 ST

(56) References Cited

U.S. PATENT DOCUMENTS

| | | | | |
|---|---|---|---|---|
| 1,746,457 A | * | 2/1930 | Bigney et al. | 24/71 J |
| 5,119,215 A | | 6/1992 | Marks et al. | |
| 5,579,559 A | * | 12/1996 | Ferrario | 24/71 J |
| 6,094,782 A | | 8/2000 | Gay et al. | |
| 6,588,069 B2 | * | 7/2003 | Deriaz et al. | 24/265 WS |

FOREIGN PATENT DOCUMENTS

| | | | |
|---|---|---|---|
| CH | 633 698 | | 12/1982 |
| CH | 665536 A | * | 5/1988 |
| CH | 676415 | | 1/1991 |
| DE | 1 557 624 | | 4/1970 |
| EP | 0115740 | | 8/1984 |
| EP | 620 986 | | 10/1994 |
| FR | 2 619 292 | | 7/1989 |
| FR | 2 665 079 | | 7/1990 |

* cited by examiner

*Primary Examiner*—James R. Brittain
(74) *Attorney, Agent, or Firm*—Sturm & Fix LLP

(57) ABSTRACT

This unfolding clasp for a bracelet has a profiled plate (1) with two spaced-apart parallel branches (1*a*) and (1*b*) defining a space (1*c*) for the assembly, in a freely articulating manner. At least one blade (2–3) has, on the side away from its articulating part, provisions for the articulated assembly of part of the bracelet. This structure is important because the blade or blades (2–3) of the bracelet are equipped, close to the part receiving the bracelet, with two rotating rollers (6–7) and (8–9) placed coaxially with and protruding from each lateral side of the blade (2–3) in order to cooperate with the profiled rim (1*d*1–1*d*2) and (1*e*1–1*e*2) of an open recess (1*d*–1*e*) formed laterally in the thickness of each branch (1*a*) and (1*b*) for the purpose of creating, after folding down of the blade (2–3), a snap-fastening effect by rolling friction resulting from tensioning of the blade. This recess (1*d*–1*e*) is equipped with means (12–13) capable of providing the stop for part of the blade or blades (2–3) in the snap-fastened position.

19 Claims, 9 Drawing Sheets

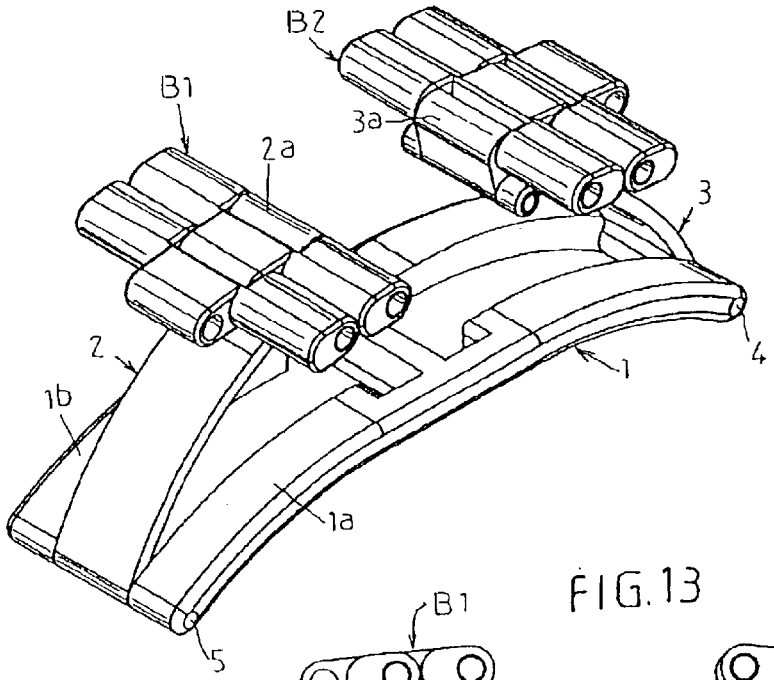
FIG.12
FIG.13
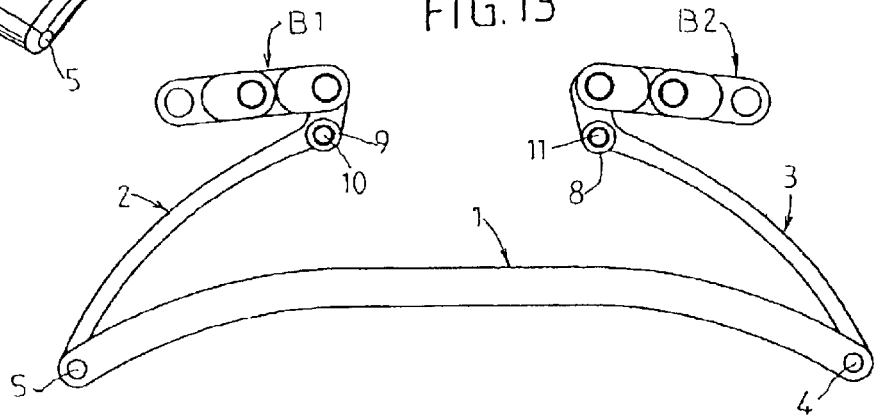
FIG.14
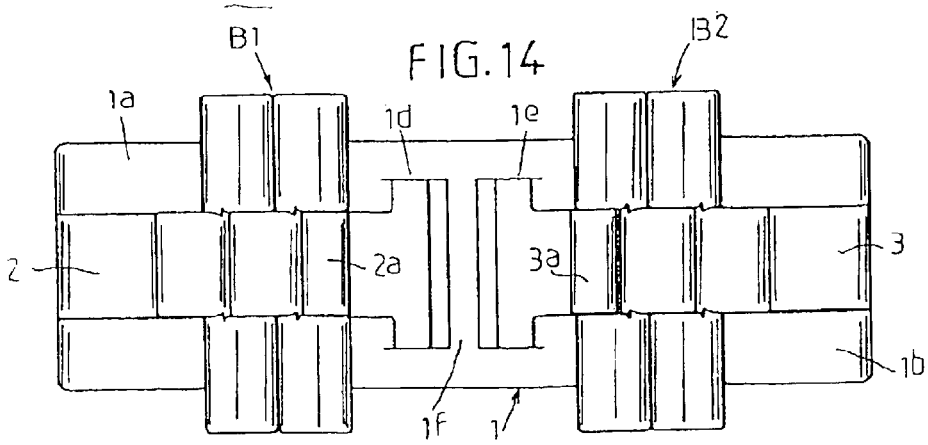

UNFOLDING CLASP FOR BRACELET

BACKGROUND OF THE INVENTION

1. Field of the Invention

The invention relates to the technical field of devices capable of coupling the free ends of a bracelet, especially but not exclusively, a watch bracelet.

Essentially, two major types of means capable of allowing bracelets to be closed can be distinguished. In a first simplified embodiment, one of the ends of the bracelet has a buckle in which the end of the other strap of the bracelet, perforated with several holes capable of cooperating with the articulated hook of the buckle, is engaged. This type of closure is generally reserved for a bracelet made of leather, plastic, fabric and, more generally, any relatively flexible material.

In contrast, this solution is not applicable to rigid or semi-rigid bracelets, such as those composed of a plurality of articulated links, for example. In this case, a clasp coupled in an articulated manner to the free ends of the straps of the bracelet is used. This clasp has different types of provision making it possible to bring the straps of the bracelet together and to keep them in a contiguous position corresponding to closure as such. The invention relates to this second type of closure.

2. Description of the Related Art

More particularly, the invention relates to a clasp of the unfolding type, as emerges, for example, from the teaching of Swiss patent CH 633 698 and French patent FR 2 619 292.

DESCRIPTION OF THE RELATED ART

In patent CH 633 698, the clasp comprises two arms coupled at one of their ends, in a freely articulating manner, to each of the straps of the bracelet. The two arms are linked together by a linking element, thereby being mounted so as to pivot at each of the ends of said element. The linking element has two notches in the shapes and dimensions corresponding to those of the arms so that the arms are entirely included in the thickness of said element when the bracelet is in the closed position. A catching system is formed at the free ends of the arms and cooperates with complementary provisions formed in the parts connecting the two notches.

This solution is not completely satisfactory, given that it is difficult to adjust the bracelet closure. Furthermore, the catching system, both when closing and opening the bracelet, is impractical to handle.

Patent FR 2,619,292 describes an unfolding clasp having a central element defining two parallel branches. These two branches accommodate, at each of their ends, in a freely articulating manner, two arms on which the straps of the bracelet are assembled. In the closed position, the arms are partially included in the thickness of the central element. To provide locking in the closed position, each arm has, at its free end, a lip capable of catching onto two rods placed transversely between the branches of the central element.

BRIEF SUMMARY OF THE INVENTION

It is therefore necessary to provide a specific shape at the ends of the arms. Here again, difficulties appear with coupling and uncoupling. The arms operate by elasticity and by sliding.

BRIEF SUMMARY OF THE INVENTION

The aim of the invention is to overcome these drawbacks, in a simple, reliable, effective and rational manner.

The problem which the invention aims to solve is to produce a clasp of simplified design and low cost price, while being shaped in order to close the bracelet in an accurate and adjustable manner, and having the option of making it from various materials.

To solve this problem, an unfolding clasp has been designed and made, of the type comprising a profiled plate having two spaced-apart parallel branches defining a space for the assembly, in a freely articulating manner, of at least one blade having, on the side away from its articulating part, provisions for the articulated assembly of part of the bracelet.

According to one feature on which the invention is based, the blade or blades of the bracelet are equipped, close to the part receiving the bracelet, with two rotating rollers placed coaxially with and protruding from each lateral side of the blade in order to cooperate with the profiled rim of an open recess formed laterally in the thickness of each branch for the purpose of creating, after folding down of the blade, a snap-fastening effect by rolling friction resulting from tensioning of the blade, said recess being equipped with means capable of providing the stop for part of the blade or blades in the snap-fastened position, corresponding to the closure position of the bracelet.

Advantageously, the invention relates to an unfolding double clasp. With this aim, the clasp has two opposed symmetrical blades articulated to each of the ends of said branches, the recess being formed substantially in the central part of said branches.

Given these technical features, the result thereof is that by exerting pressure at the end of the blades corresponding to a pressing force, and when the neutral point of snap-fastening, corresponding to the passage of the rotating rollers over the profiled edge of the recess, is exceeded, the automatic snap-fastening of the clasp is obtained in a concomitant manner. The radius of the blades increases.

According to another feature, the means of stopping the blades in the snap-fastened position consist of transverse rollers assembled between the lateral edges of the recess, thereby acting as a spacer.

Advantageously, the clasp has two rollers which are mutually parallel and parallel to the spindle of the rotating rollers of the blades.

Similarly, the profiled plate assembly can be produced as a single piece, such that the means of stopping the blades in the snap-fastened position consist of at least one transverse branch formed directly during the manufacture of said plate, thereby being positioned substantially in the central part of the recess.

To solve the problem set of stopping the blades while allowing them to be handled, the ends of the blades away from their articulation have a profiled shape oriented at an angle above the rotating rollers, thereby being capable of pressing on the spacer rollers, said shapes being arranged in a substantially contiguous manner in the snap-fastened position of the blades.

In this closure position, the blades are completely integrated into the thickness of the space resulting from spacing the two branches.

To solve the problem set of ensuring the coupling of the two straps of the bracelet, the free ends of the profiled shapes are perforated transversely straight through the assembly, with articulation of the corresponding parts of the bracelet.

To solve the problem set of decreasing costs and of facilitating the assembly of the entire clasp, the spacer rollers consist of a tube placed between the lateral edges facing the recess, thereby being assembled on a hollow spindle engaged in the thickness of the branches, said spindle accommodating, at each of its ends, detachable means for translational locking.

To solve the problem set of being able to increase or decrease the snap-fastening force as desired, the coaxial snap-fastening rollers are mounted so as to rotate on a common spindle with the capacity to be dismantled in order to adjust their diameter to the desired snap-fastening force.

BRIEF DESCRIPTION OF THE DRAWINGS

The invention is explained in more detail below with the aid of the figures of the appended drawings in which:

FIG. 12 is a view similar to FIG. 11, after assembly of the links of the bracelet;

FIG. 13 is a front view of the clasp in the open position;

FIG. 14 is a plan view corresponding to FIG. 13.

DETAILED DESCRIPTION OF THE INVENTION

Figure 1:
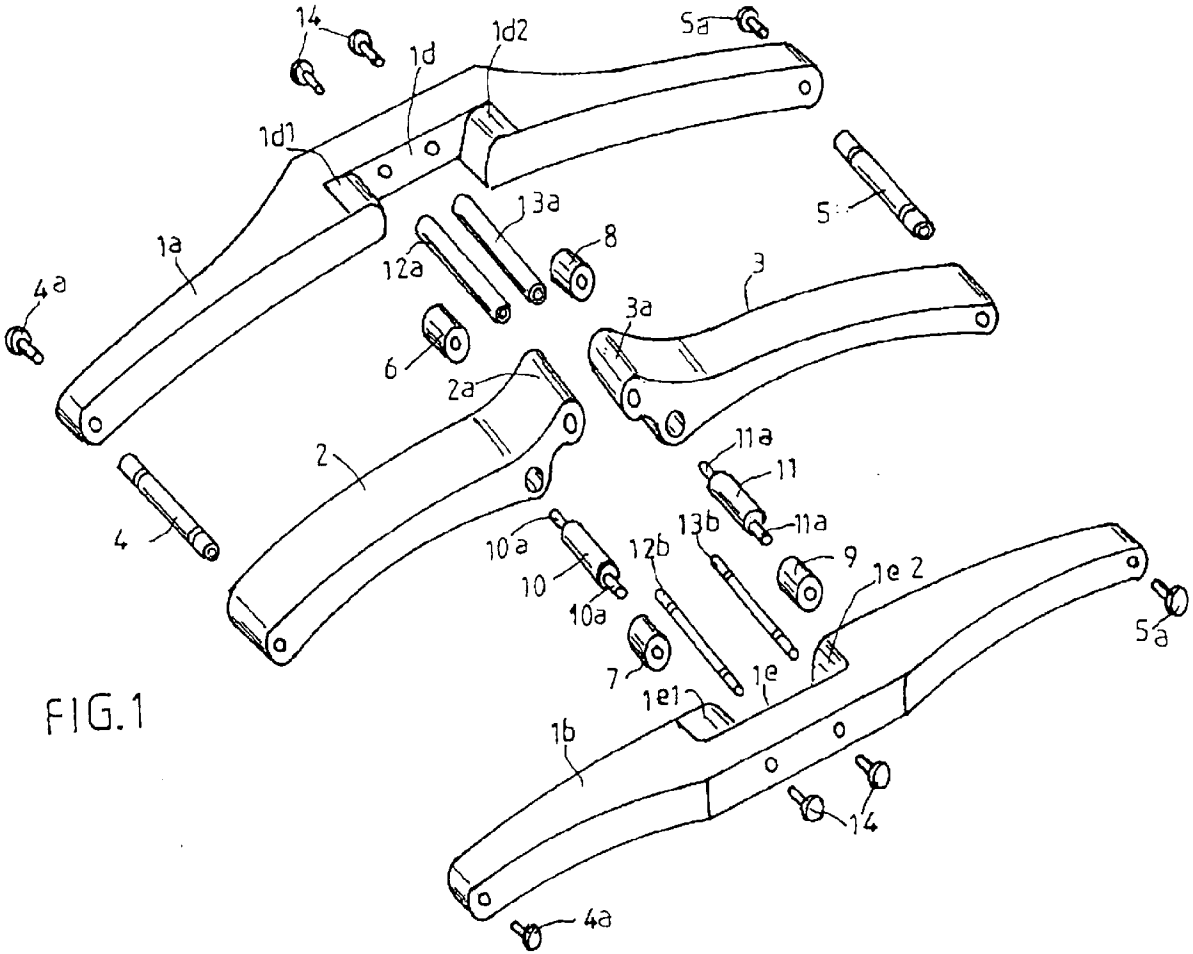
FIG. 1 is a perspective view, before assembly of the main constituent elements, of the clasp according to the invention.
Figure 2:
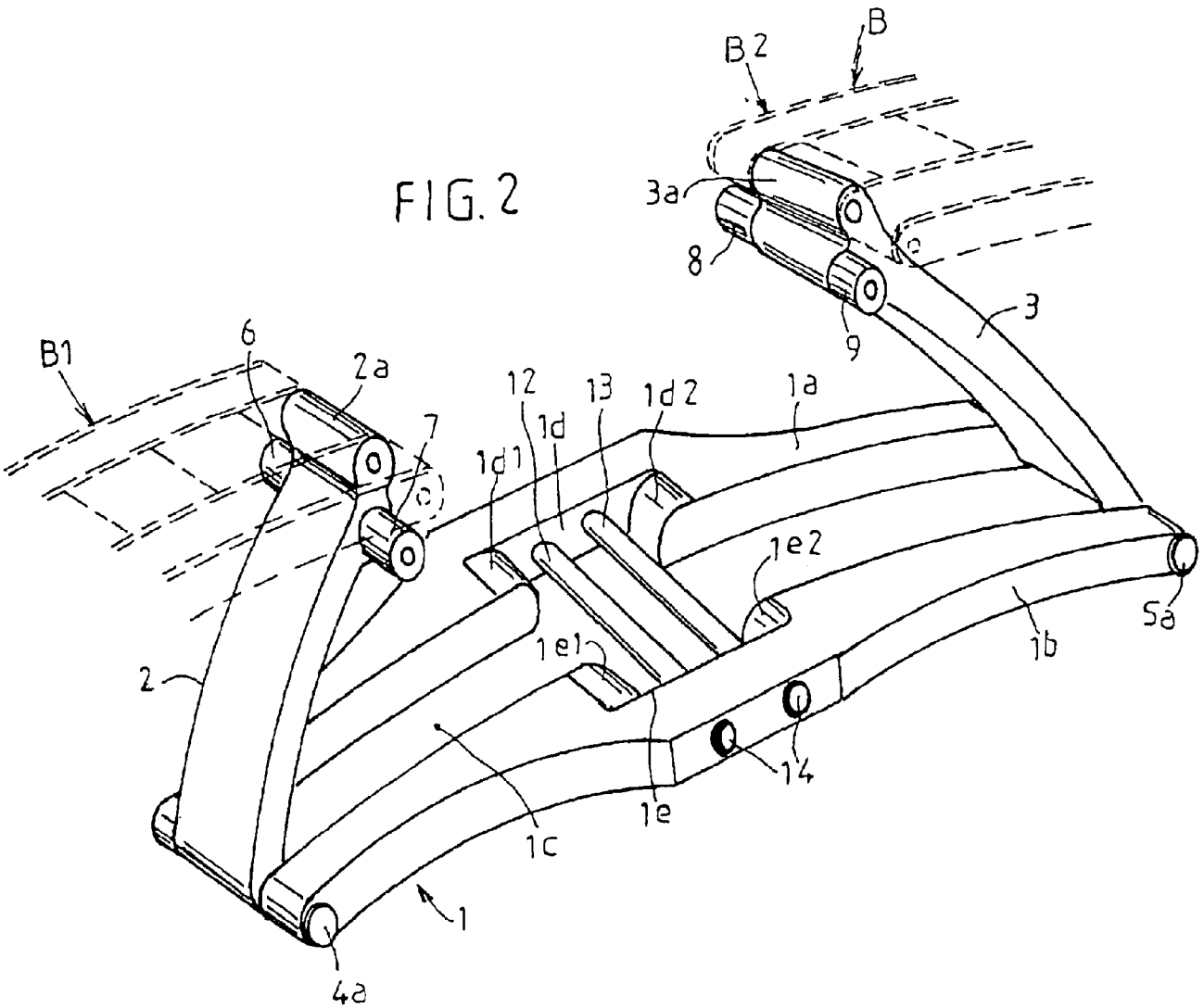
FIG. 2 is a view corresponding to FIG. 1 after assembly of the constituent elements of the clasp.

As shown especially in FIGS. 1 and 2, the unfolding clasp comprises a profiled plate (1) having two parallel branches (1*a*) and (1*b*). The two branches (1*a*) and (1*b*) define a space (1*c*) for the assembly, in a freely articulating manner, of at least one, but preferably two symmetrical and identical blades (2) and (3). The two blades (2) and (3) are articulated between the two branches (1*a*) and (1*b*), at each of their ends, by means of a transverse spindle (4) and (5).

For example, each of the spindles (4) and (5) consists of a hollow tube engaged transversely in the thickness of the branches (1*a*) and (1*b*), being held there in translation by rivets (4*a*) and (5*a*). In the known manner, the plate (1) and the branches (2) and (3) are bent longitudinally. Similarly, still in a known manner, the free ends of the blades (2) and (3), away from their articulation (4) and (5), have any type of provision for the assembly in a freely articulating manner of the straps (B1) and (B2) of the bracelet (B).

According to an important feature of the invention, each blade (2) and (3) is equipped, close to the free end where the straps (B1) and (B2) of the bracelet are articulated, with two rotating rollers (6-7) and (8-9) placed coaxially, protruding from each lateral side of said blades (2) and (3). These rollers (6-7) and (8-9) are designed to cooperate with a profiled rim (1*d*1–1*d*2) and (1*e*1–1*e*2) which has a recess (1*d*) and (1*e*) formed laterally in the thickness of each branch (1*a*) and (1*b*). The rims (1*d*1–1*d*2) and (1*e*1–1*e*2) are connected above each of the branches (1*a*) and (1*b*), by a cam-shaped profile capable of creating, after folding down the corresponding blades (2) and (3) into a space (1*c*), a snap-fastening effect by rolling friction on engagement of the rotating rollers (6-7) and (8-9). This results, in a concomitant manner, in tensioning of the blades (2) and (3) by increasing their radius of curvature, as will be indicated below in the description.

It should be noted that the profiled edges (1*d*1–1*d*2) and (1*e*1–1*e*2) are determined so as to allow the blades (2) and (3) to be snapped-fastened under a low tensile force and, conversely, said blades to be uncoupled under a relatively high tensile force, in order to prevent any inadvertent uncoupling.

As is shown especially in FIG. 1, the rollers (6-7) and (8-9) are arranged coaxially by being assembled so that they can turn on a common spindle (10-11) housed transversely in the thickness of each of the branches (2 and 3). Each of the spindles (10 and 11) has, at each of its ends, a circular bearing surface (10*a* and 11*a*) for the rotating assembly, with the capacity to be dismantled, of rollers or wheels (6-7) and (8-9). Given these arrangements, it is thus possible to use a rotating roller having a different diameter depending on the desired snap-fastening force.

According to another feature, transverse rollers (12 and 13) are assembled between the opposed lateral edges of the recesses (1*d*) and (1*e*) . These rollers (12) and (13) act as spacer for the branches (1*a*) and (1*b*), and provide a stop for part of the blades (2) and (3) in the snap-fastened position. The two rollers (12) and (13) are parallel to each other and to the spindles (10) and (11) of the rotating rollers (6-7) and (8-9). In the example illustrated, the spacer rollers (12) and (13) consist of a tube (12*a*) and (13*a*) placed between the lateral edges facing the recesses (1*d*) and (1*e*). The tubes (12*a*) and (13*a*) are assembled on a hollow spindle (12*b*) and (13*b*) engaged in the thickness of the branches (1*a*) and (1*b*) at the recess (1*d*) and (1*e*). The spindles (12*b*) and (13*b*) accommodate, at each of their ends, detachable means for translational locking consisting, for example, of a pin (14).

Figure 2A:
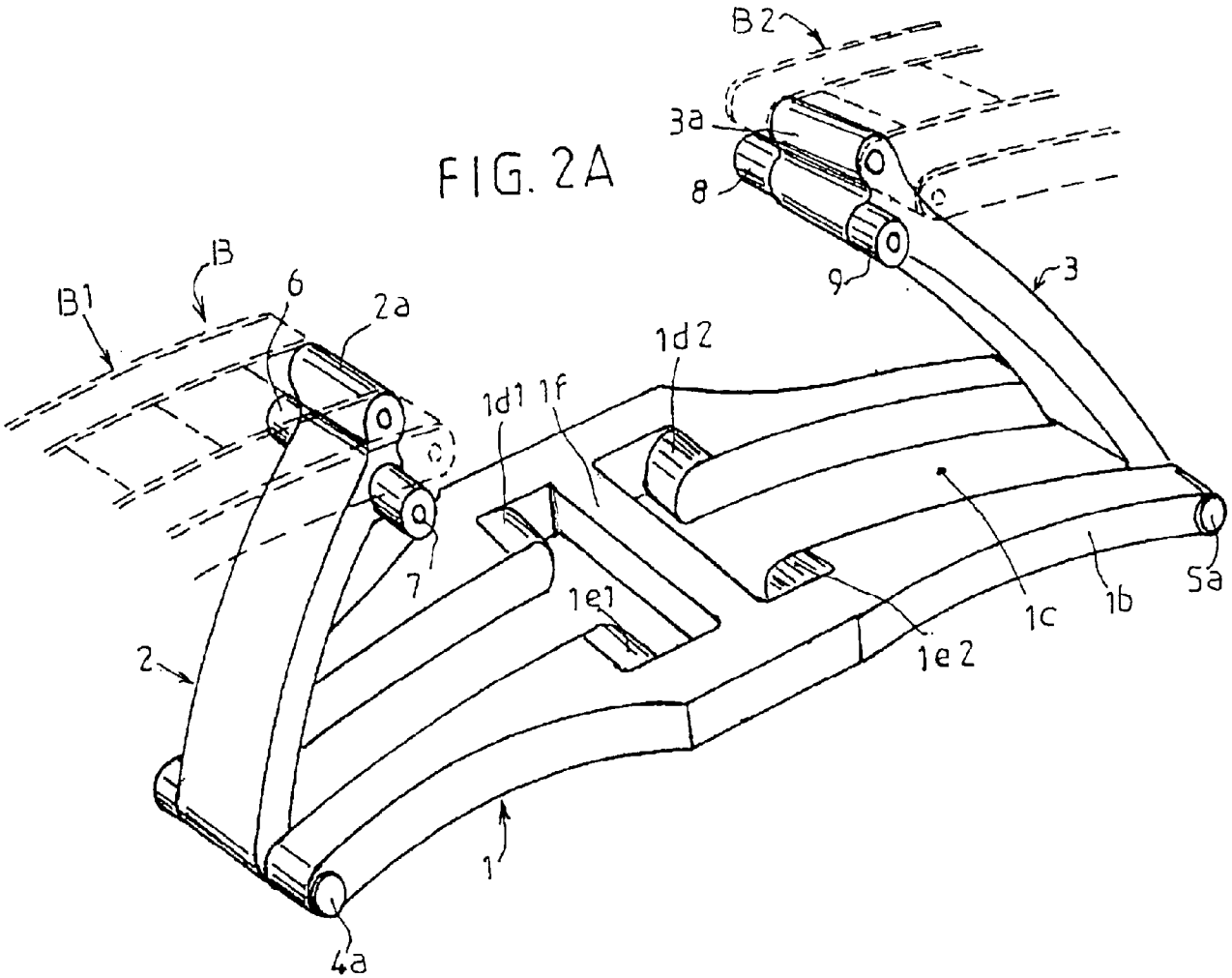
FIG. 2A is a view similar to FIG. 2 showing a variant embodiment of the profiled plate accommodating the blades.
Figure 10:
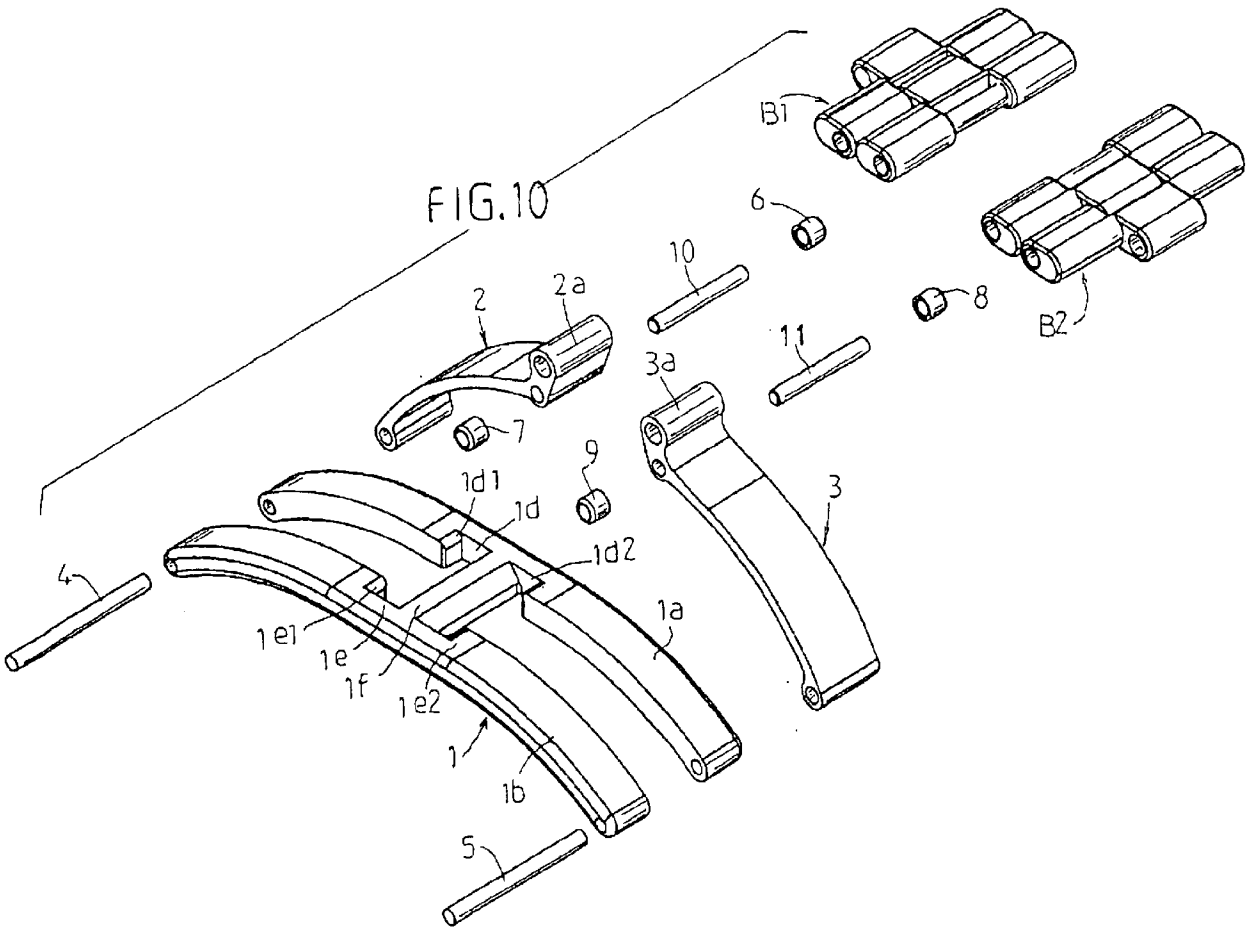
FIG. 10 is a perspective view of a preferred embodiment of the unfolding clasp according to the invention; the various constituent elements are shown before assembly, as are the links of the bracelet.
Figure 11:
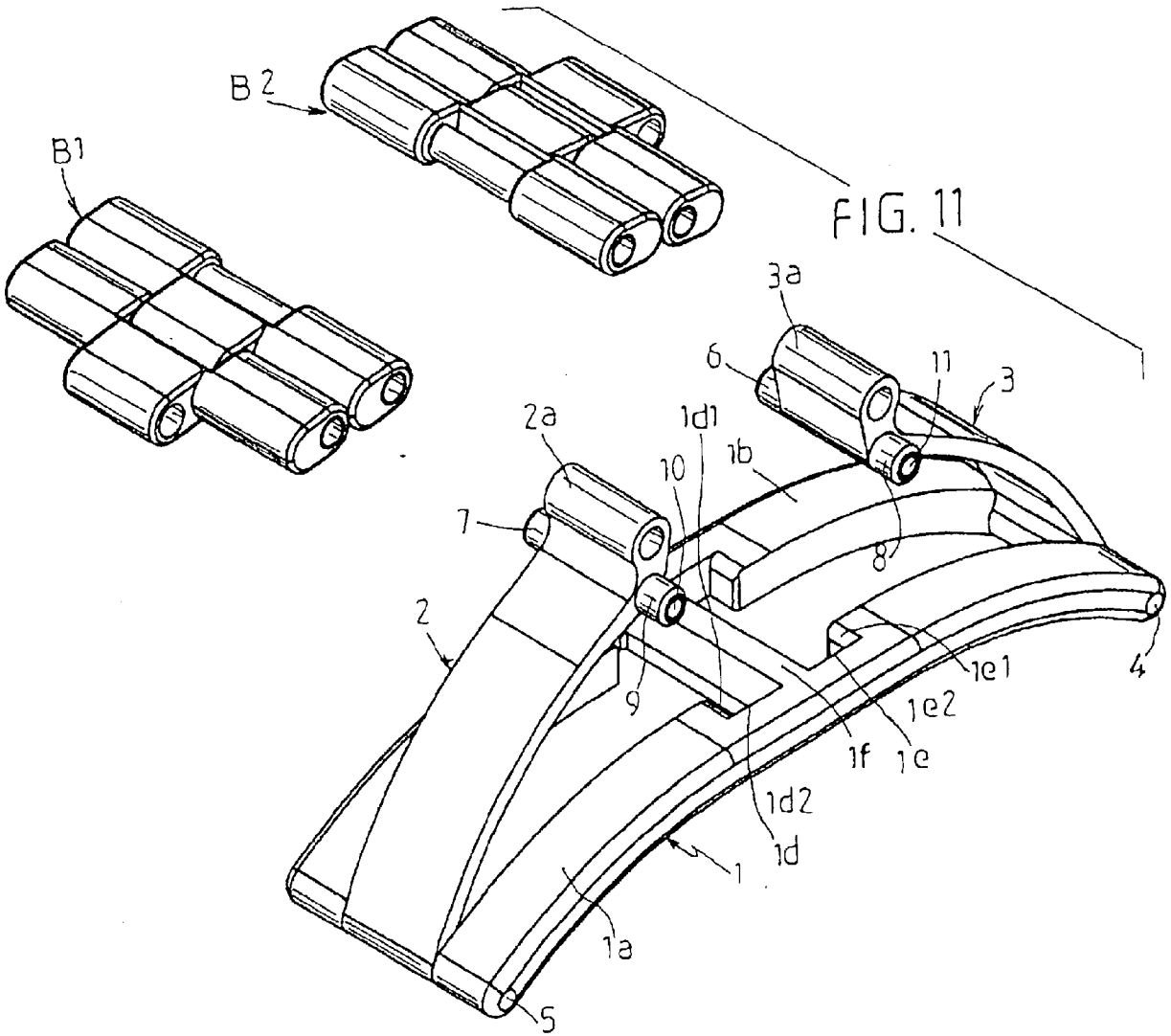
FIG. 11 is a perspective view corresponding to FIG. 10, after assembly of the constituent elements of the clasp and before assembly of the links of the bracelet.

In another embodiment, and as emerges from FIG. 2A and from FIGS. 10, 11 and 12, for the purpose of simplification and reducing costs, the assembly of the profiled plate (1), with the two branches (1*a*) and (1*b*) defining the space (1*c*), is produced integrally, that is to say as a single part. The means of stopping the blades (2) and (3) in the snap-fastened position consist of a transverse branch (1*f*) directly connected to the lateral branches (1*a*) and (1*b*) to which the blades (2) and (3) are articulated. The transverse branch (11) is positioned substantially in the central part of the recess (1*d*–1*e*).

The ends of the blades (2) and (3) away from their articulation spindle (4) and (5) have a profiled head (2*a*) and (3*a*) oriented at an angle above the rotating rollers (6-7) and (8-9). The profiled heads (2*a*) and (3*a*) are capable of pressing on the spacer rollers (12) and (13) or the transverse branch (1*f*). In the snap-fastened position of the blades (2) and (3), the profiled heads (2*a*) and (3*a*) are arranged in a substantially contiguous manner.

In the example illustrated, the heads (2*a*) and (3*a*) are perforated transversely straight through, for the assembly, in a freely articulating manner, of the ends of the straps (B1) and (B2) of the bracelet in question. For example, the heads (2*a*) and (3*a*) allow the assembly, in a freely articulating manner, of the links of a bracelet.

Figure 3:
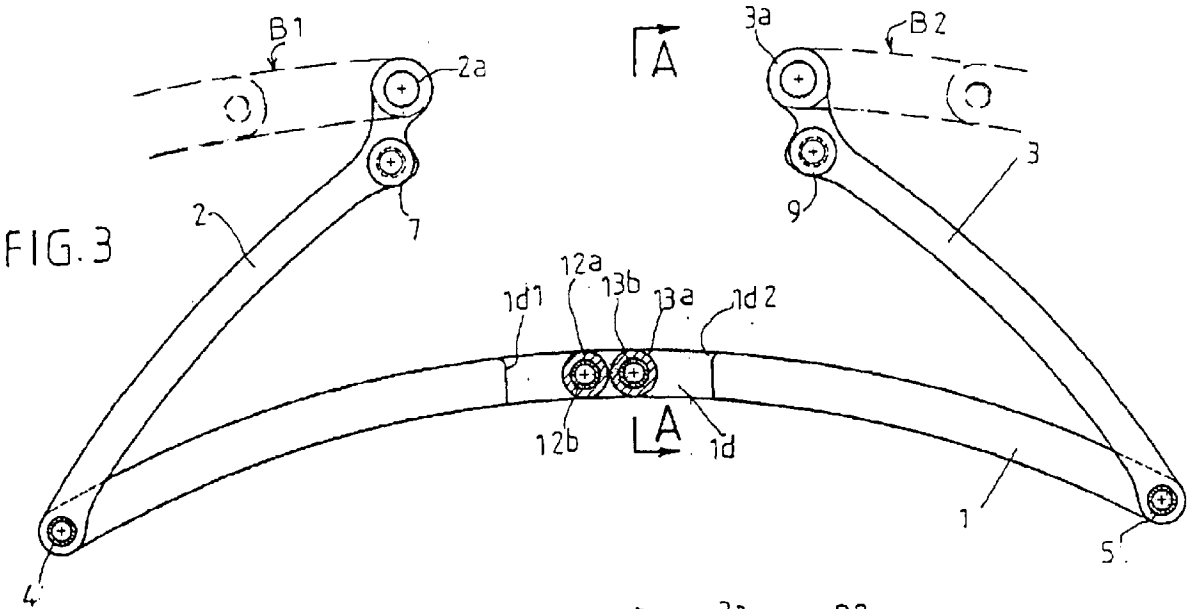
FIG. 3 is a view in longitudinal section of the clasp, in the open position.
Figure 4:
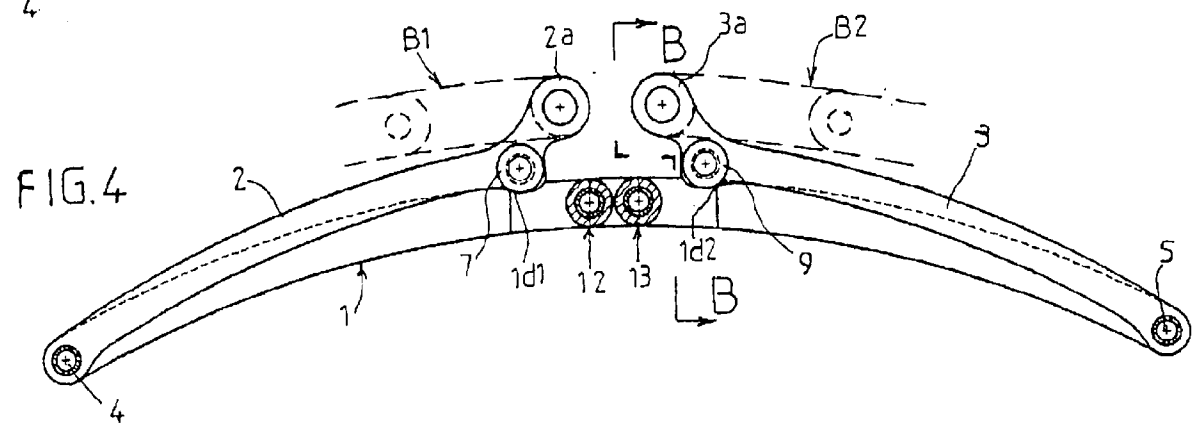
FIG. 4 is a view similar to FIG. 3 showing the start of the snap-fastening.
Figure 5:
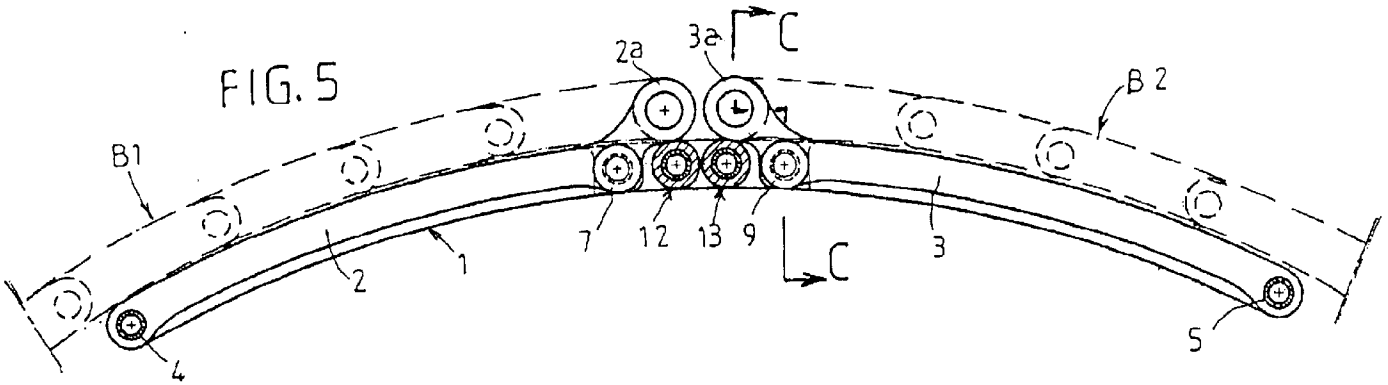
FIG. 5 is a view similar to FIG. 4 in the snap-fastened position of the branches.
Figure 6:
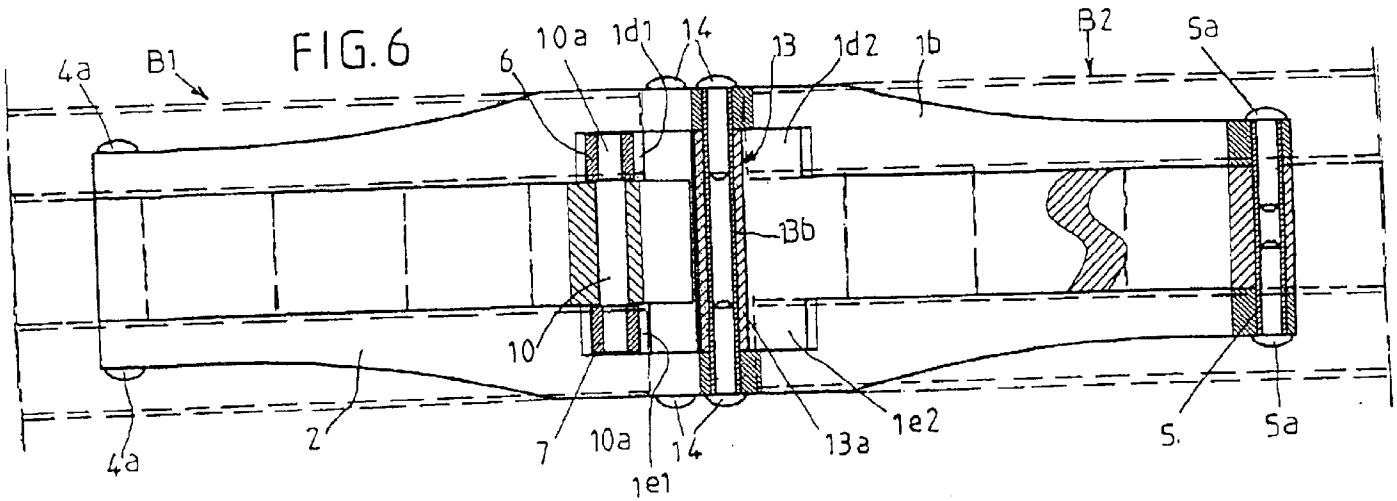
FIG. 6 is a plan view in partial section corresponding to FIG. 5.
Figure 9:
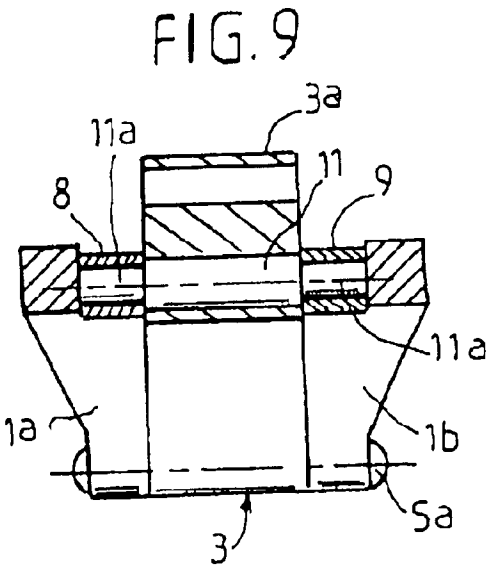
FIG. 9 is a cross-sectional view taken along the line C—C of FIG. 5.
Figure 8:
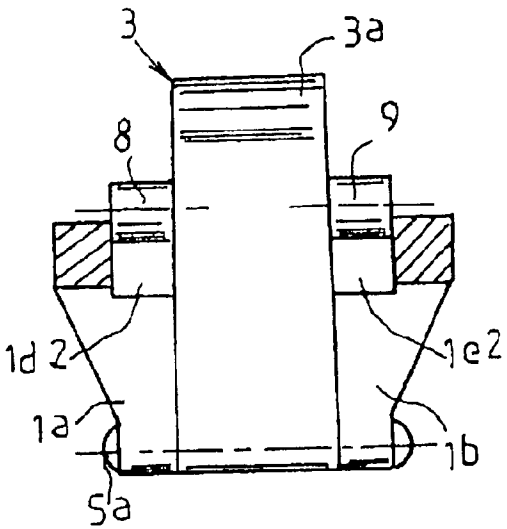
FIG. 8 is a cross-sectional view taken along the line B—B of FIG. 4.
Figure 7:
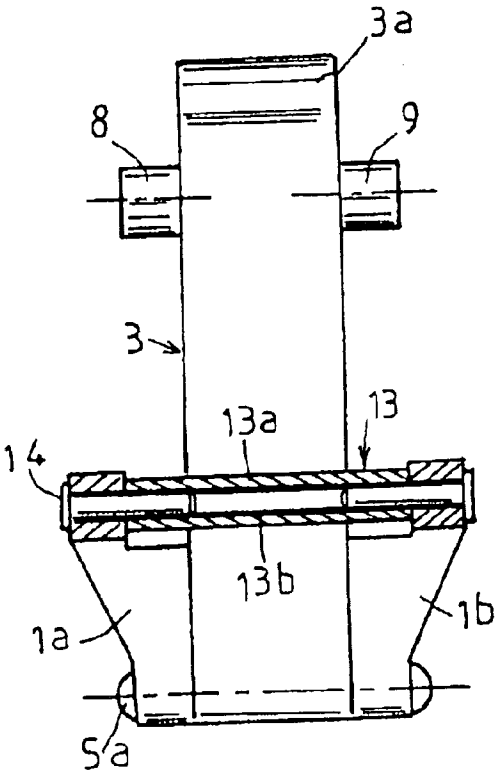
FIG. 7 is cross-sectional view taken along the line A—A of FIG. 3.

Given these features, reference is particularly made to FIGS. 3, 4 and 5, which show the clasp in the open position (FIG. 3), in the snap-fastened position (FIG. 4), that is to say at the moment when the rollers (6-7) and (8-9) attack the ramp-shaped profile (1*d*1–1*d*2) and (1*e*1–1*e*2) of the recesses (1*d*) and (1*e*), and in the snap-fastened position (FIG. 5), that is to say when the rollers (6-7) and (8-9), under the effects of pressure (P) exerted on the profiled heads (2*a*) and (3*a*), have exceeded the neutral point of snap-fastening. The component resulting therefrom ensures the automatic snap-fastening of the clasp. The radius of curvature of the blades (2) and (3) increases.

In this snap-fastened position, the blades (2) and (3) are completely integrated into the space (1*c*) of the two branches (1*a*) and (1*b*).

Given the features on which the invention is based, the clasp assembly may be made from any material. Advantageously, but not exclusively, it may be made from carbon fiber, the blades being injection-molded without a demolding slide, which makes it possible to significantly reduce the costs. Still with the objective of decreasing the costs, by simplifying the manufacture, the plate assembly may be produced, as indicated, as a single piece.

The advantages clearly emerge from the description, of which the following are emphasized and summarized in particular:

- the snap-fastening by rolling friction of the two coaxial rollers on extending the blades by increasing their radius of curvature;
- the ease of snap-fastening by the low rolling friction;
- increasing and decreasing the snap-fastening force by adjusting the diameter of the rotating snap-fastening rollers;
- the possibility of obtaining a high snap-fastening slope, as well as a large snap-fastening travel;
- the safety of the closure;
- the possibility of using a blade of small width given the coaxial rotating rollers;
- simplicity of production;
- decrease in costs;
- use of simplified and standard parts.

What is claimed is:

1. An unfolding clasp for a bracelet comprising: a profiled plate having two spaced-apart parallel branches defining a space for the assembly, in a freely articulating manner, of at least one blade having, on a side away from an articulating part of the at least one blade, provisions for articulated assembly of part of the bracelet, wherein the blade or blades of the bracelet are equipped, close to the part receiving the bracelet, with two rotating rollers placed coaxially with and protruding from each lateral side of the blade in order to cooperate with a profiled rim of an open recess formed laterally in the thickness by spaced lateral edges of each branch for the purpose of creating, after folding down of the blade, a snap-fastening effect by rolling friction resulting from tensioning of the blade, said recess being equipped with means for stopping the blade or blades in the snap-fastened position, wherein the means of stopping the blades in the snap-fastened position consists of transverse rollers assembled between the lateral edges of the recess, thereby acting as a spacer.

2. The clasp as claimed in claim 1, wherein said clasp has two opposed symmetrical blades articulated to each of the ends of the branches, the recess being formed substantially in a central part of said bracelet.

3. The clasp as claimed in claim 1, wherein said spacer rollers comprise rollers which are mutually parallel and parallel to the spindle of the rotating rollers of the bracelet.

4. The clasp as claimed in claim 1, wherein the ends of the blades away from their articulation to the branches have a profiled shape oriented at an angle above the rotating spacers rollers, thereby being capable of pressing on the spacer rollers, said shapes being arranged in a substantially contiguous manner in the snap-fastened position of the blades.

5. The clasp as claimed in claim 4, wherein the free ends of the profiled shapes are perforated transversely straight through the assembly, with articulation of the corresponding parts of the bracelet.

6. The clasp as claimed in claim 1, wherein the coaxial snap-fastening rollers are mounted so as to rotate on a common spindle with the capacity to be dismantled in order to adjust their diameter to the desired snap-fastening force.

7. The clasp as claimed in claim 1, wherein the spacer rollers consist of a tube placed between the lateral edges facing the recess, thereby being assembled on a hollow spindle engaged in the thickness of the branches, said spindle accommodating, at each of its ends, detachable means for translational locking.

8. The clasp as claimed in claim 1, wherein the assembly of the plate and of the blades is bent longitudinally.

9. An unfolding clasp for a bracelet comprising: a profiled plate having two spaced-apart parallel branches defining a space for assembly, in a freely articulating manner, of at least one blade having, on a side away from an articulating part of the at least one blade, for articulated assembly of part of the bracelet, wherein the blade or blades of the bracelet are equipped, close to the part receiving the bracelet, with two rotating rollers placed coaxially with and protruding from each lateral side of the blade in order to cooperate with a profiled rim of an open recess formed laterally in the thickness by spaced lateral edges of each branch for the purpose of creating, after folding down of the blade, a snap-fastening effect by rolling friction resulting from tensioning of the blade, said recess being equipped with means for stopping the blade or blades in the snap-fastened position, wherein the coaxial snap-fastening rollers are mounted so as to rotate on a common spindle with the capacity to be dismantled in order to adjust their diameter to the desired snap-fastening force.

10. An unfolding clasp for a bracelet comprising: a profiled plate having two spaced-apart parallel branches defining a space for assembly, in a freely articulating manner, of at least one blade having, on a free end away from an articulating part of the at least one blade provision for articulated assembly of part of the bracelet, wherein the blade or blades of the unfolding clasp are equipped on said free end two rotating transverse rollers placed coaxially with and protruding from each lateral side of the blade in order to cooperate with a profiled rim of an open recess formed laterally in the thickness by spaced lateral edges of each branch for the purpose of creating, after folding down of the blade, a snap-fastening effect by rolling friction resulting from tensioning of the blade, said recess being equipped with means for stopping of the blades or blades in the snap-fastened position.

11. The clasp as claimed in claim 10, wherein said clasp has two opposed symmetrical blades articulated to each of the ends of the branches, the recess being formed substantially in a central part of said branches.

12. The clasp as claimed in claim 10, wherein the means for stopping the blades in the snap-fastened position consist of transverse rollers assembled between the lateral edges of the recess, thereby acting as a spacer.

13. The clasp as claimed in claim 12, wherein said spacer rollers comprise two rollers which are mutually parallel and parallel to a spindle of the rotating rollers of the blades.

14. The clasp as claimed in claim 10, wherein the means for stopping the blades in the snap-fastened position consist of at least one transverse branch positioned substantially in a central part of the recess and formed directly during the manufacture of the profiled plate.

15. The clasp as claimed in claim 12, wherein the ends of the blades away from their articulation to the branches have a profiled shaped oriented at an angle above the rotating spacer rollers, thereby being capable of pressing on the spacer rollers, said shapes being arranged in a substantially contiguous manner in the snap-fastened position of the blades.

16. The clasp as claimed in claim 15, wherein the free ends of the profiled shapes are perforated transversely straight through the assembly, with articulation of the corresponding parts of the bracelet.

17. The clasp as claimed in claim 10, wherein the coaxial snap-fastening rollers are mounted so as to rotate on a common spindle with the capacity to be dismantled in order to adjust their diameter to the desired snap-fastening force.

18. The clasp as claimed in claim 12, wherein the spacer rollers consists of a tube placed between the lateral edges facing the recess, thereby being assembled on a hollow spindle engaged in the thickness of the branches, said spindle accommodating, at each of its ends, detachable means for translational locking.

19. The clasp as claimed in claim 10, wherein the assembly of the plate and of the blades is bent longitudinally.

* * * * *